US009890476B2

(12) United States Patent
Kübler et al.

(10) Patent No.: US 9,890,476 B2
(45) Date of Patent: Feb. 13, 2018

(54) SPINNING UNIT OF AN AIR SPINNING MACHINE ALONG WITH A TOP FRAME FOR THE FIXING OF A SPINNING NOZZLE OF AN AIR SPINNING MACHINE

(71) Applicant: Maschinenfabrik Rieter AG, Winterthur (CH)

(72) Inventors: Markus Kübler, Geislingen (DE); Gernot Schäffler, Wäschenbeuren (DE); Andreas Fischer, Steckborn (CH)

(73) Assignee: Maschinenfabrik Rieter AG, Winterthur (CH)

( * ) Notice: Subject to any disclaimer, the term of this patent is extended or adjusted under 35 U.S.C. 154(b) by 238 days.

(21) Appl. No.: 14/677,184

(22) Filed: Apr. 2, 2015

(65) Prior Publication Data

US 2015/0284878 A1 Oct. 8, 2015

(30) Foreign Application Priority Data

Apr. 3, 2014 (CH) ..... 523/14

(51) Int. Cl.

| | |
|---|---|
| ***D01D 5/06*** | (2006.01) |
| ***D01H 1/115*** | (2006.01) |
| ***D01H 13/30*** | (2006.01) |

(52) U.S. Cl.

CPC ..... *D01D 5/06* (2013.01); *D01H 1/115* (2013.01); *D01H 13/306* (2013.01)

(58) Field of Classification Search

CPC ..... D01H 13/306

See application file for complete search history.

(56) References Cited

U.S. PATENT DOCUMENTS 5,193,335 A 3/1993 Mori

FOREIGN PATENT DOCUMENTS

| | | |
|---|---|---|
| DE | 41 22 216 A1 | 2/1992 |
| EP | 1 072 702 A2 | 1/2001 |
| EP | 2 107 141 A2 | 10/2009 |
| EP | 2 450 478 A2 | 5/2012 |
| EP | 2 620 532 A1 | 7/2013 |
| EP | 2 767 625 A1 | 8/2014 |
| FR | 2 704 005 | 10/1994 |
| JP | 2008 095208 | 4/2008 |

OTHER PUBLICATIONS

EPO Search Report, dated Oct. 6, 2015.
Swiss Patent Office Search Report, dated Aug. 15, 2014.

*Primary Examiner* — Ryan Ochylski
(74) *Attorney, Agent, or Firm* — Dority & Manning P.A.

(57) ABSTRACT

A spinning unit of an air jet spinning machine with a spinning nozzle, which serves the purpose of producing a yarn from a fiber composite fed to the spinning nozzle. The spinning nozzle features an inlet for the fiber composite, an internal vortex chamber, a yarn formation element protruding into the vortex chamber along with an outlet for the yarn produced inside the vortex chamber. The spinning unit is allocated with an additive supply, which is designed to supply the spinning nozzle with an additive. The additive supply includes at least one top frame fixed on the spinning nozzle, through which the additive is able to be fed to the spinning nozzle. In addition, a top frame for fixing on a spinning nozzle of an air jet spinning machine is proposed.

12 Claims, 5 Drawing Sheets

SPINNING UNIT OF AN AIR SPINNING MACHINE ALONG WITH A TOP FRAME FOR THE FIXING OF A SPINNING NOZZLE OF AN AIR SPINNING MACHINE

FIELD OF THE INVENTION

This invention relates to a spinning unit of an air jet spinning machine with a spinning nozzle, which serves the purpose of producing a yarn from a fiber composite fed to the spinning nozzle, whereas the spinning nozzle features an inlet for the fiber composite, an internal vortex chamber, a yarn formation element protruding into the vortex chamber along with an outlet for the yarn produced inside the vortex chamber.

Furthermore, a top frame for fixing on a spinning nozzle of an air jet spinning machine is proposed, whereas the spinning nozzle serves the purpose of producing a yarn from a fiber composite fed to the spinning nozzle, whereas the spinning nozzle features an inlet for the fiber composite, an internal vortex chamber, a yarn formation element protruding into the vortex chamber along with an outlet for the yarn produced inside the vortex chamber.

BACKGROUND

Air jet spinning machines with corresponding spinning units are known in the state of the art, and serve the purpose of producing a yarn from an elongated fiber composite. Thereby, the outer fibers of the fiber composite are, with the assistance of a vortex air flow generated by the air nozzles within the vortex chamber in the area of the inlet mouth of the yarn formation element, wound around the internal core fibers, and ultimately form the winding fibers that determine the desired strength of the yarn. This creates a yarn with a genuine twist, which may be ultimately led away through a draw-off channel from the vortex chamber, and wound up, for example, on a sleeve.

In general, within the meaning of the invention, the term "yarn" is understood to be a fiber composite, for which at least one part of the fibers is wound around an internal core. Thus, this comprises a yarn in the conventional sense, which may be processed into a fabric, for example with the assistance of a weaving machine. However, the invention also relates to air jet spinning machines, with the assistance of which so-called "roving" (another name: coarse roving) may be produced. This type of yarn is characterized by the fact that, despite a certain strength, which is sufficient to transport the yarn to a subsequent textile machine, it is still capable of drafting. Thus, the roving may be drafted with the assistance of a drafting device, for example the drafting system, of a textile machine processing the roving, for example a ring spinning machine, before it is ultimately spun.

In the production of synthetic fibers, such as polyester, or mixtures of natural and synthetic fibers, deposits on the surface of the yarn formation element arise. The production of synthetic fibers comprises a so-called "preparation of continuous fibers" during the production process. Preparation agents, usually oils with various additives, are applied at the continuous fibers; this enables a treatment such as, for example, drafting the continuous fibers at high speeds. Such preparation agents sometimes adhere to the synthetic fibers even during the further treatment, and lead to impurities in the air jet spinning machine. The fibers fed to the air jet spinning machine in the form of a fiber composite are typically fed by a pair of delivery rollers of the spinning nozzle. The pair of the delivery rollers may correspond to a pair of output rollers of a drafting system. The drafting system that is used serves the purpose of the refinement of the advanced fiber composite prior to entering the spinning nozzle.

Typically, a fiber guide element is arranged in the entrance area of the spinning nozzle; through this, the fiber composite is led into the spinning nozzle and finally into the area of the yarn formation element. In the majority of cases, spindles with an internal draw-off channel are used as yarn formation elements. At the top of the yarn formation element, compressed air is introduced through the housing wall of the spinning nozzle in such a manner that the specified rotating vortex air flow arises. As a result, individual external fibers are separated from the fiber composite leaving the fiber guide element and are turned over through the top of the yarn formation element. In the further process, these removed fibers rotate on the surface of the yarn formation element. Following this, through the forward movement of the internal core fibers of the fiber composite, the rotating fibers are wound around the core fibers and thereby form the yarn. However, through the movement of the individual fibers over the surface of the yarn formation element, deposits also form on the yarn formation element because of adhesions on the fibers from the production process. Deposits on the yarn formation element may also be caused by damaged fibers. For the same reasons, deposits may also occur on the surface of the interior of the spinning nozzle or the fiber guide element. These adhesions lead to deterioration of the surface condition of the yarn formation element, and cause a deterioration in the quality of produced yarn. Therefore, the regular cleaning of the affected surfaces is necessary in order to maintain the consistent quality of the spun yarns.

The surfaces of the yarn formation element and the fiber guide element may be cleaned manually through a periodic disassembly of the yarn formation element, but this leads to a substantial maintenance effort, coupled with a corresponding interruption in operations.

By contrast, EP 2 450 478 discloses a device that enables an automatic cleaning without stopping the machine. For this purpose, an additive is mixed with the compressed air used for the formation of vortex air flow within the spinning nozzle. The additive is guided through the compressed air on the yarn formation element, and results in the cleaning of the surface of the yarn formation element.

JP-2008-095-208 discloses an additional version of the cleaning of the yarn formation element. An additive is also fed to the compressed air used for the swirling in the spinning nozzle, and with such compressed air, is led into the spinning nozzle, and thus to the yarn formation element. In the disclosed version, the dosage and the addition of the additive is separately provided for each spinning unit.

It is disadvantageous for the disclosed cleaning systems that the dosage of the additive depends on the compressed air supply of the air nozzles. Thus, a dosage that is independent of this is ruled out.

In principle, the same problem also occurs if the additive is to be fed to the fiber composite, in order to improve the properties of the yarn produced from it, with regard to (for example) its hairiness or strength, because, in such a case, the dosage should be adjustable with high degree of precision, in order to prevent more than or less than the indicated target additive quantity from being applied to the individual sections of the fiber composite.

SUMMARY OF THE INVENTION

Therefore, a task of this invention is to propose a solution, which enables a supply of the spinning nozzle with additive that is particularly consistent and to be adjusted precisely. Additional objects and advantages of the invention will be set forth in part in the following description, or may be obvious from the description, or may be learned through practice of the invention.

The objects are solved by a spinning unit of an air jet spinning machine and a top frame with the characteristics set forth herein.

In accordance with the invention, the spinning unit is characterized by the fact that it is allocated with an additive supply, which is designed to provide the spinning nozzle with an additive, whereas the additive supply includes at least one top frame fixed on the spinning nozzle, through which the additive provided by an additive supply line of the additive supply is able to be fed to the spinning nozzle. Thus, the additive is not introduced through the air nozzles of the spinning nozzle as known in the state of the art. Rather, a separate top frame is proposed, through which the spinning unit may be supplied independent of the compressed air flowing through the air nozzle. The top frame may be designed in one part or multiple parts and, if there are corresponding fixing elements, may also be subsequently attached to existing spinning nozzles. If the top frame is connected to a corresponding additive supply line, the additive that originates, for example, from a pressure tank storing the additive or another additive reservoir may be fed to the spinning nozzle in the desired dosage, whereas it is preferable that a corresponding additive outlet of the top frame is placed in the area of the inlet of the spinning nozzle, in order to apply the additive to the fiber composite coming into the spinning nozzle.

At this, it is advantageous if the top frame is fixed in a detachable manner to the spinning nozzle, with the assistance of, for example, a clip connection. In such a case, the top frame may be easily removed from the spinning nozzle, and replaced with a different top frame. As a result, different top frames may be used, depending on the additive or type of fiber composite, in order to adjust the quantity of the additive delivered through the top frame under the respective conditions. The fastening may take place, for example, through one or more positively locking elements, such that the top frame, upon its fixing, must only be pressed against the spinning nozzle, and is finally held by a click-on or clip connection. Alternatively, a non-detachable connection, for example through adhesive bonding between the top frame and the spinning nozzle or its housing, is of course conceivable.

It is also advantageous if the top frame is at least partially made of a plastic. Depending on the choice of the plastic, the top frame has a high degree of resistance to the wide variety of additives that are used (liquid or solid substances or mixtures of the same may serve as additives, whereas water or an aqueous solution is preferential). For example, it is conceivable to craft the top frame as an injection-molded part. The top frame may also feature one or more coatings, in order to increase the surface quality. Of course, the top frame may also be crafted from a metal or formed in multiple parts, whereas the individual components may consist of various materials and/or may be connected to each other in a detachable manner.

It is also highly advantageous if the top frame features at least one, preferably internal, channel with a channel inlet that is in fluid connection with the additive supply line and a channel outlet that is in fluid connection with the spinning nozzle. Thus, the top frame forms a channel wall that at least partially encloses the channel. Alternatively, the top frame may also feature a recess arranged in the area of one of its surfaces, which forms a part of a channel. In such a case, the second part of the channel may be formed by a surface section of the spinning nozzle, to which the top frame abuts (for example, through an intermediate gasket) in such a manner that the top frame and the spinning nozzle together form the actual channel. In addition, the channel inlet may feature a connection area, for example in the form of a connection piece, which may be connected to the specified additive supply line.

It is also advantageous if the channel outlet is arranged in the area of the inlet of the spinning nozzle. In such a case, the additive leaving the top frame through the channel outlet may be applied directly to the fiber composite coming into the spinning nozzle. The channel outlet is also preferably located in a ring section or partial ring section forming the inlet or surrounding it, such that the additive may be applied to it vertically or at an angle to the transport direction of the fiber composite. Depending on the quantity of the additive to be dosed, this ultimately serves the purpose of cleaning the yarn formation element or improving the specified properties of the yarn produced from the fiber composite.

It is particularly advantageous if the channel outlet is arranged in the area of a fiber guide element that is arranged in the area of the inlet of the spinning nozzle, such that the additive flowing through the channel can be brought into contact, in the area of the fiber guide element, with the fiber composite introduced through the fiber guide element into the spinning nozzle. The fiber guide element serves the purpose of guiding the fiber composite upon entering the spinning nozzle, and surrounds it, preferably in a circumferential direction running perpendicular to the specified transport direction. While the channel outlet of the top frame may be arranged in the area of a front side of the fiber guide element pointing outwards in relation to the vortex chamber, it is also conceivable that the channel outlet leads to a passage channel formed by the fiber guide element, which is passed by the fiber composite upon entering the spinning nozzle.

It is particularly advantageous if the top frame features an end section that encloses the channel outlet, through which it is fixed in the area of the fiber guide element, preferably on the fiber guide element itself. The end section may be designed in one part or multiple parts, and may be held to the fiber guide element in a positively locking or force-fitting manner. For example, it is conceivable that the end section is plugged or clipped to a ring-shaped outer circumference of the fiber guide element.

It is also advantageous if the end section is designed at least partially in a ring-shaped manner, and is fixed, preferably in a positive locking manner, to a retaining section. The end section is connected (for example, detachably) to the retaining section, whereas the retaining section is a component of the fiber guide element or a component of the top frame, or whereas the retaining section is present as a separate section of the spinning nozzle, for example its housing. In particular, it is advantageous if the end section surrounds the retaining section, and is connected to this in a positive locking or force-fitting manner.

It is advantageous if the retaining section is designed at least partially in a ring-shaped manner. For example, it is conceivable that the retaining section surrounds the fiber guide element at its outer circumference and is thereby plugged to it. Likewise, the retaining section, together with the fiber guide element, may form the entrance channel of the spinning nozzle, through which the fiber composite enters the vortex chamber. Preferably, the retaining section also includes grooves or bulges directed outwards, through which it is connected in a detachable manner with the rest of the spinning nozzle or the top frame or a section thereof, whereas, in the latter case, the retaining section itself may be a part of the top frame.

It is also advantageous if the retaining section at least partially surrounds the fiber guide element, or is formed by it. While, in the first case, the retaining section can be penetrated by the fiber guide element, the fiber guide element in the second case features, for example, fastening elements, through which the top frame can be fastened to the fiber guide element.

It is advantageous if the retaining section is a component of the top frame, whereas the retaining section is connected (preferably, in a detachable manner) to a base body of the top frame, and particularly consists of, at least partially, a material that is different than that of the top frame. For example, it is conceivable to craft the base body from plastic and craft the retaining section from a different material, which is particularly resistant to abrasion, since the retaining section primarily comes into contact with the fiber composite.

It is also advantageous if the retaining section features a channel section that leads to the inlet of the spinning nozzle. If the retaining section is a part of the top frame, the channel outlet of the top frame is located in the area of the retaining section. By contrast, if the top frame exists as a component that is separate from the retaining section, the channel section of the top frame, together with the channel section of the retaining section, forms the actual channel that must be passed by the additive after entering into the top frame, before it exits via the channel outlet and hits the fiber composite.

It is also advantageous if the channel section of the retaining section is directed against the specified transport direction of the fiber composite introduced into the spinning nozzle. For example, the channel section of the retaining section may include an angle with the transport direction that is between 20° and 80°, preferably between 30° and 70°. In such a case, the additive is redirected upon leaving the channel section and is transported from the fiber composite into the vortex chamber.

It is also advantageous if the top frame is at least partially fixed to a spinning air entry element of the spinning nozzle. The spinning air entry element is designed, for example, as a connection piece, through which the air supply line is connected to the spinning nozzle and through which the compressed air necessary for the twist insertion may flow into the spinning nozzle. For example, it is conceivable that the top frame features a break or another free space, with which it is plugged on the connection piece or fastened to this and finally held in a positive locking manner.

It is also highly advantageous if the channel of the top frame within the top frame features, at least in sections, a curved or bent run. The channel and/or the top frame may extend, for example, from a side area of the spinning nozzle into a front section of the same featuring the inlet. In this case, the channel would run initially counter to the transport direction of the fiber composite, and then in the direction of the inlet. In any case, a curved or bent run of the channel and/or the top frame allows for a feed of the additive at a location that is spaced from the channel outlet of the top frame or from the inlet of the spinning nozzle.

The top frame in accordance with the invention for a spinning nozzle finally includes at least one, preferably internal, channel with one channel inlet and one channel outlet, through which an additive provided by an additive supply line can be fed to the spinning nozzle after fixing the top frame to the spinning nozzle. With regard to possible characteristics of the top frame, reference is made to the previous and following description, whereas the characteristics can be realized individually or in any combination, to the extent that the characteristics are not in opposition to each other. In particular, the top frame in the area of the channel inlet should feature a connection section, for example a connection piece, through which it is connectable to an additive supply line.

It is further advantageous if the top frame in accordance with the invention for a spinning nozzle is, based on the diameter ratios of the internal channel, or the channel inlet and/or channel outlet, provided with a color identifier. In doing so, a unique identifier may be provided at a certain location of the top frame, or the top frame itself may be produced in a specific color. Any confusion can be ruled out by the color identification of the different top frames that could be used for various applications. The volume flow or mass flow of an additive to be dosed may change through the use of various top frames in their area or the type of feed.

It is also advantageous if the top frame features an end section that includes the channel outlet, whereas the end section is preferably designed at least partially in a ring-shaped manner, and whereas the end section includes a retaining section that can be fixed, preferably in a positively locking manner, to the spinning nozzle in the area of the inlet of the spinning nozzle. For example, the retaining section may be fixable to a fiber guide element of the spinning nozzle. Furthermore, it is advantageous if the channel of the top frame within the top frame features, at least in sections, a curved or bent run, since the additive may thereby be transported, for example, from a side area of the spinning nozzle to the area of its inlet.

BRIEF DESCRIPTION OF THE DRAWINGS

Additional advantages of the invention are described in the following embodiments. The following is shown.

DETAILED DESCRIPTION

Figure 1:
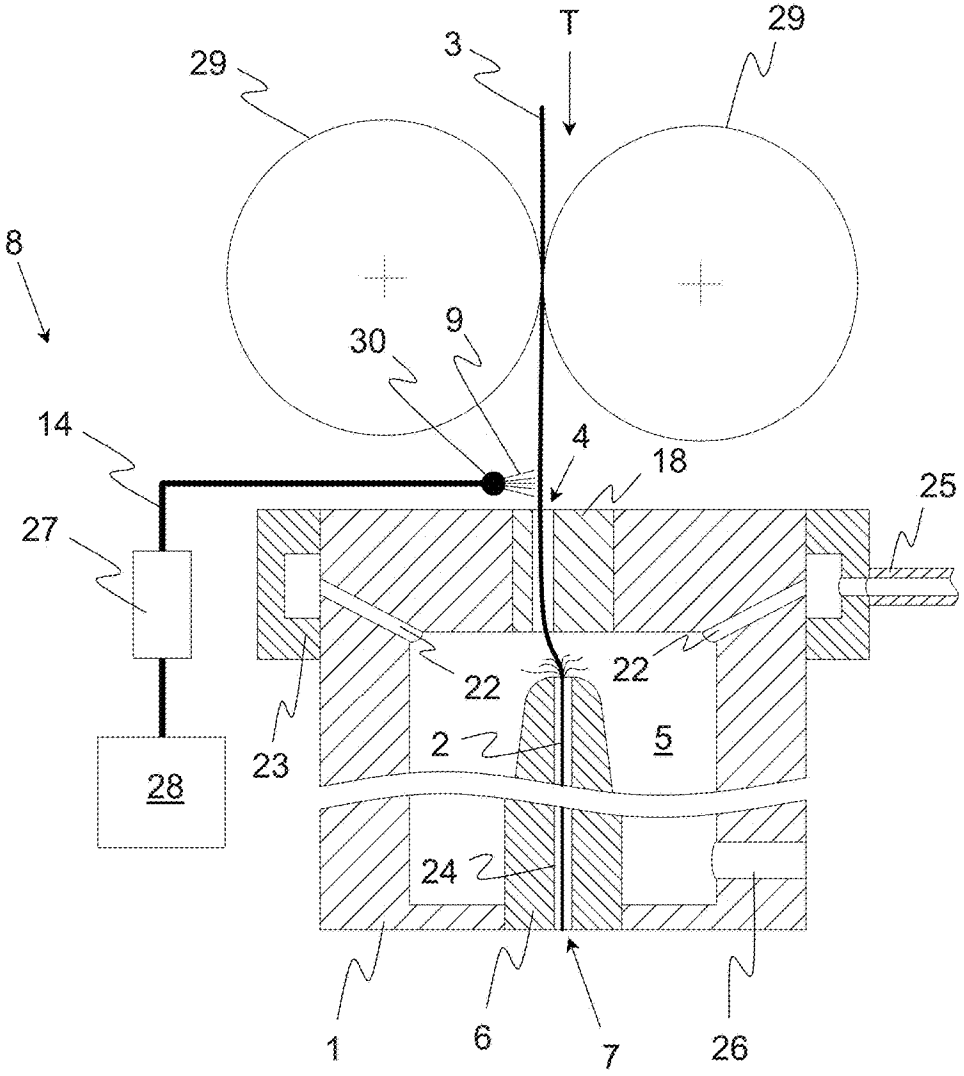
FIG. 1 a cut-out of a spinning unit of an air jet spinning machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a cut-out of a spinning unit in accordance with the invention of an air jet spinning machine (whereas the air jet spinning machine may, of course, feature a multitude of spinning units, preferably arranged in a manner adjacent to each other). When required, the air jet spinning machine may include a drafting system that includes several drafting system rollers 29, which is supplied with a fiber composite 3 in the form of, for example, a doubled sliver. Furthermore, the spinning unit that is shown comprises a spinning nozzle 1 with an internal vortex chamber 5, in which the fiber composite 3 or at least a part of the fibers of the fiber composite 3 is, after passing an inlet 4 of the spinning nozzle 1, provided with a twist (the exact mode of action of the spinning unit is described in more detail below).

Moreover, the air jet spinning machine may include a pair of draw-off rollers (not shown) that is placed downstream of the spinning nozzle 1 along with a winding-up device (also not shown) downstream of the pair of draw-off rollers with a sleeve for winding up the yarn 2 leaving the spinning unit. The spinning unit in accordance with the invention need not necessarily feature a drafting system. The pair of draw-off rollers is also not absolutely necessary.

Generally, the spinning unit that is shown works according to an air spinning process. For the formation of the yarn 2, the fiber composite 3 is led into the vortex chamber 5 of the spinning nozzle 1, in a transport direction T via a fiber guide element 18, which is provided with an inlet opening forming the specified inlet 4. At that point, it receives a twist; that is, at least a part of the free fiber ends of the fiber composite 3 is captured by a vortex air flow that is generated by air nozzles 22 correspondingly arranged in a vortex chamber wall surrounding the vortex chamber 5 (whereas the air nozzles 22 are supplied with compressed air, for example through an air distributor 23, which flows through an air supply line 25 into the air distributor 23). Thereby, a part of the fibers is pulled out of the fiber composite 3 at least to some extent, and wound around the top of a yarn formation element 6 protruding into the vortex chamber 5.

Given that the fiber composite 3 is extracted through an inlet mouth of the yarn formation element 6 through a draw-off channel 24 arranged within the yarn formation element 6, out of the vortex chamber 5, and finally through an outlet 7 out of the spinning nozzle 1, the free fiber ends are also ultimately drawn in the direction of the inlet mouth and thereby, as so-called "winding fibers," loop around the core fiber running in the center—resulting in a yarn 2 featuring the desired twist. The compressed air introduced through the air nozzles 22 leaves the spinning nozzle 1 ultimately through the draw-off channel 24 along with an air outlet 26 that might be present, which, when required, may be connected to a vacuum power source.

In general, it must be clarified at this point that the produced yarn 2 generally comprises any fiber composite 3, which is characterized by the fact that an external part of the fibers (so-called "winding fibers") is looped around an internal part of the fibers that is preferably untwisted or, where required, twisted, in order to impart the desired strength to the yarn 2. The invention also comprises an air jet spinning machine, with the assistance of which so-called "roving" may be produced. The roving may comprise a yarn 2 with a relatively low proportion of winding fibers, or a yarn 2 for which the winding fibers are looped, relatively loosely, around the inner core, such that the yarn 2 remains capable of drafting. This is crucial if the produced yarn 2 should be or must be drafted on a subsequent textile machine (for example, a ring spinning machine), once again with the assistance of a drafting system, in order to further process it accordingly.

With regard to the air nozzles 22, it must also be mentioned at this point, purely as a matter of precaution, that they typically should be generally aligned in such a manner that the escaping air streams are unidirectional, in order to generate a unidirectional air flow with a rotational direction. Preferably, the individual air nozzles 22 are thereby arranged in a manner that is rotationally symmetric to each other, and tangentially flow into the vortex chamber 5.

In accordance with the invention, the spinning unit is allocated with an additive supply system 8, which includes one or more additive reservoirs 28 along with one or more additive supply lines 14, which are preferably at least partially flexible, through which the respective additive reservoir 28 (for example, a pressure tank filled with additive 9 and compressed air) is in fluid connection with an additive delivery device 30 arranged in the area of the spinning nozzle 1 (with regard to possible additives 9, reference is made to the prior description).

Preferentially, the additive delivery device 30 is located in the area of the inlet 4 of the spinning nozzle 1 (such that the additive 9 may be applied to the fiber composite 3), whereas the additive delivery device 30 in accordance with the invention takes place with a top frame 10 shown in FIGS. 2 to 5, which will be described in more detail in the further course.

In order to deliver the additive 9 through the additive delivery device 30 in a manner that is precise and highly reproducible, and also to adjust the delivered volume flow or mass flow of the additive 9 to the respective circumstances, the additive supply 8 also includes at least one adjustable valve 27, which is preferably integrated into the corresponding additive supply line 14, and the additive 9 thus flows through it.

Figure 2:
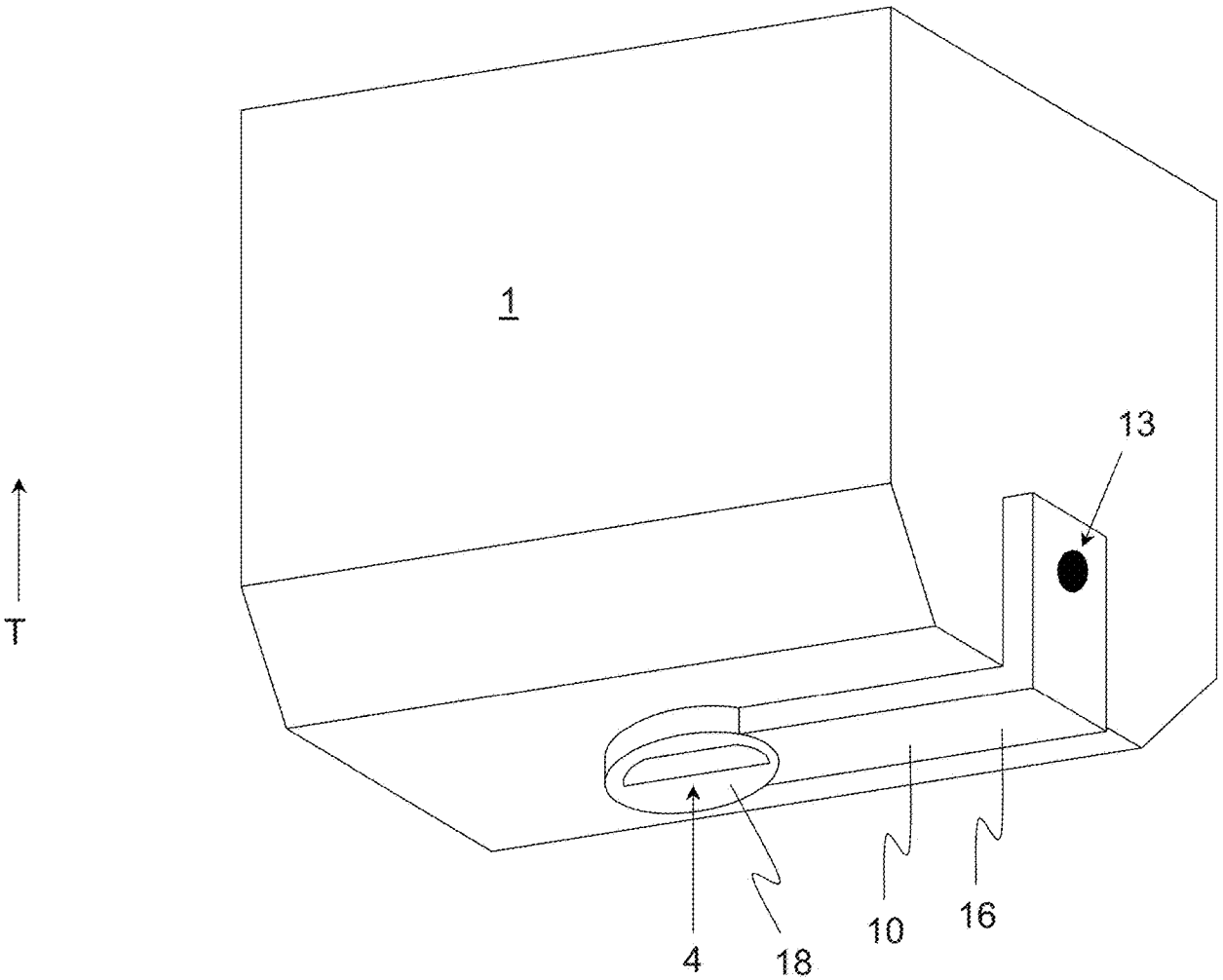
FIG. 2 a spinning nozzle with a top frame in accordance with the invention.
Figure 3:
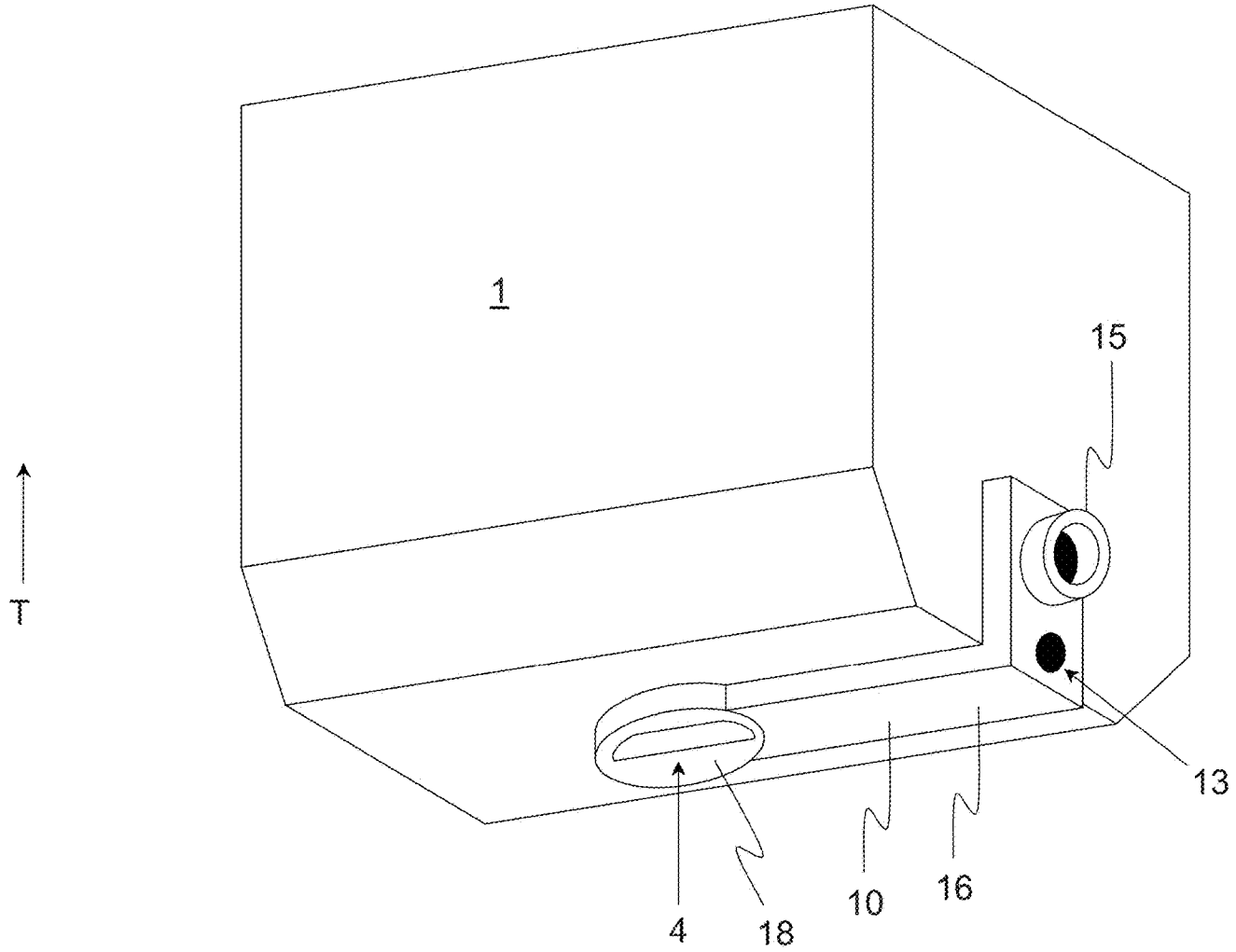
FIG. 3 a spinning nozzle with an additional top frame in accordance with the invention, FIG. 4 a sectional view of a cut-out of a spinning nozzle with a top frame in accordance with the invention, and FIG. 5 a sectional view of a cut-out of an additional spinning nozzle with a further embodiment of a top frame in accordance with the invention.

FIG. 2 shows a first possible embodiment of a top frame 10 used in accordance with the invention. The top frame 10 has a channel inlet 13 through which additive 9 may enter through an additive supply line 14 that is not shown (which is connected to the top frame 10) into a channel 12 running inside the top frame 10 (see FIGS. 4 and 5). The additive 9 flows through the channel 12 into the area of the inlet 4 of the spinning nozzle 1 and at that point is applied to the fiber composite 3, which enters the spinning nozzle 1 in the transport direction T that is shown.

The top frame 10 and the channel 12 may feature a curved or bent run, such that the channel inlet 13 may be located at the side surface of the spinning nozzle 1, while the delivery of the additive 9 may take place in the area of a front side featuring the inlet 4. In the case of FIG. 2, the top frame 10 abuts the fiber guide element 18, and is connected to the spinning nozzle 1, for example in a glued or positively locking manner.

In one embodiment of the solution shown in FIG. 2, the top frame 10 may feature a break, through which it is held to a spinning air entry element 15 (see FIG. 3), whereas the spinning air entry element 15 is connected to, for example, a compressed air line (not shown), through which the air nozzles 22 are supplied with compressed air.

Figure 4:
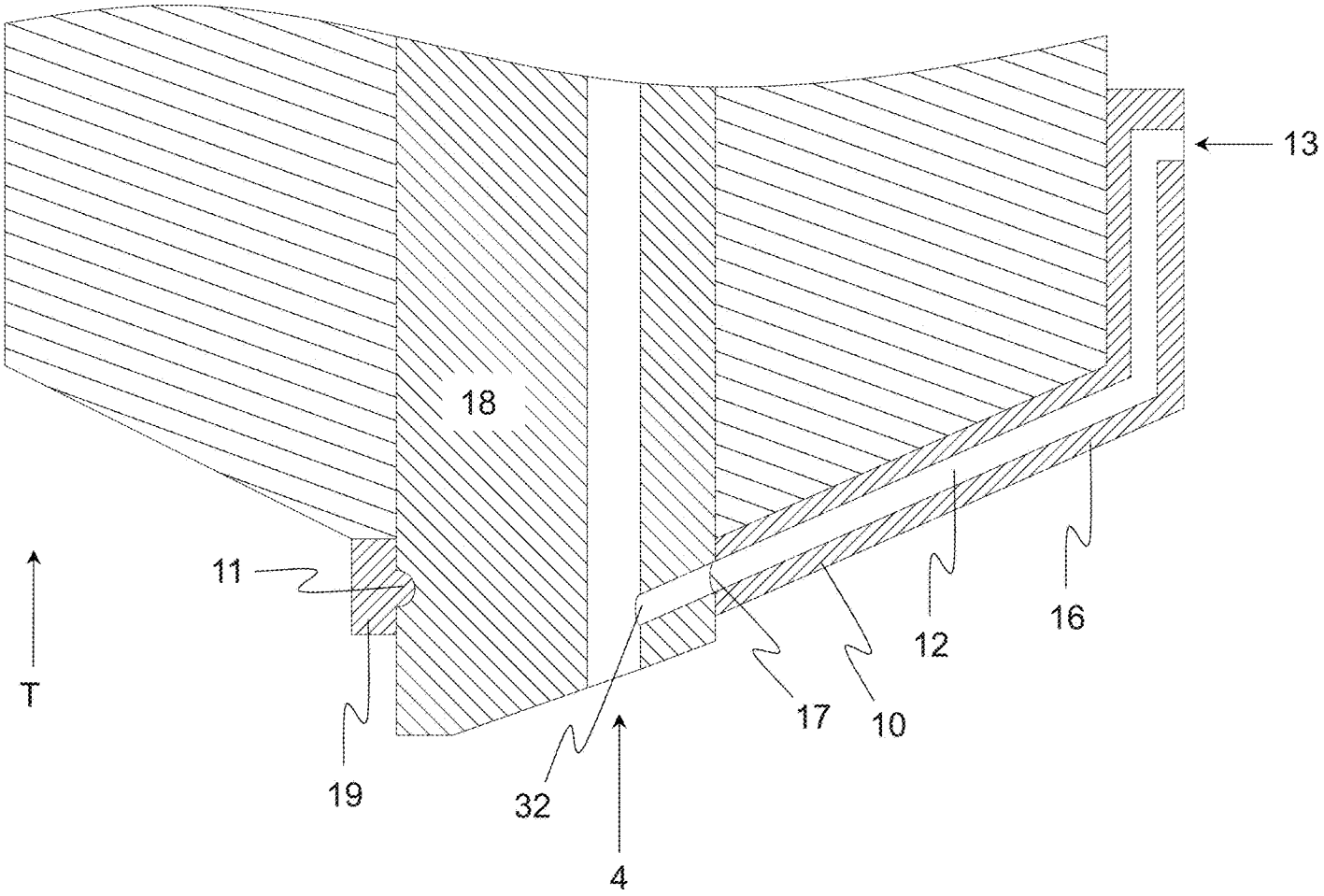

FIG. 4 shows a section through a cut-out of a spinning nozzle 1 along with a top frame 10 that is detachably connected to it. The top frame 10 has an end section 19 that, for example, is designed at least partially in a ring-shaped manner, through which it is connected to the fiber guide element 18 through a clip connection 11. It also is shown in FIG. 4 that the channel 12 running inside the top frame 10 features a channel outlet 17, which borders an inlet channel 32 of the fiber guide element 18, such that the additive 9 may ultimately be applied inside the fiber guide element 18 to the fiber composite 3. An adjustment of the dosing area may also take place through various proportions or forms of the internal channel 12, or the channel inlet 13 or channel outlet 17.

Figure 5:
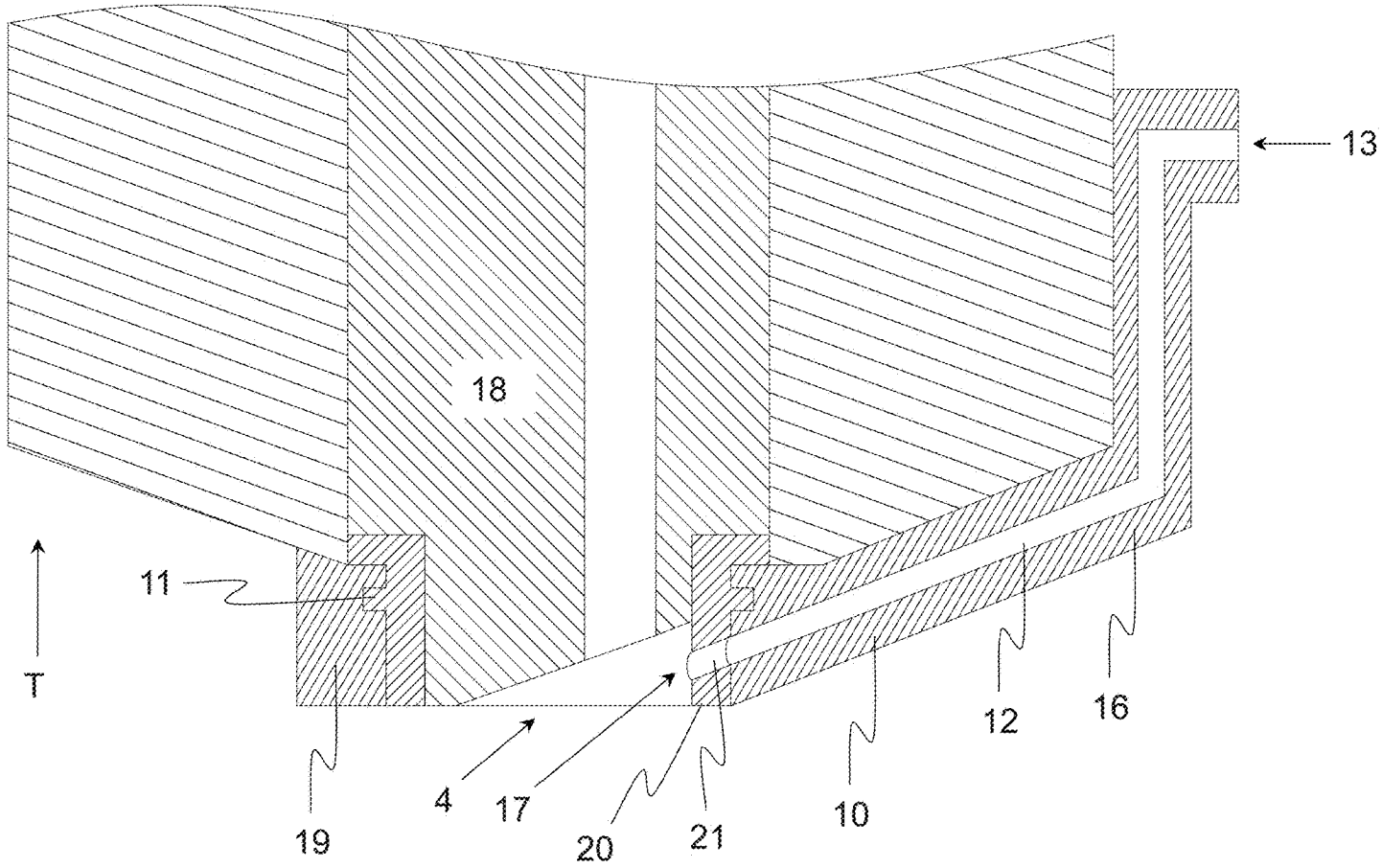

Finally, it is also possible that the spinning nozzle 1 or the top frame 10 includes a retaining section 20 shown in FIG. 5, which is fastened (for example, in a positively locking and/or force-fitting manner) to a housing of the spinning nozzle 1 or to the fiber guide element 18, whereas the retaining section 20 is in turn connected to a base body 16 of the top frame 10. In such a case, the connection may also take place in a detachable manner, for example with the assistance of a clip connection 11.

It is also advantageous if the retaining section 20, which may be designed (for example) in a ring-shaped manner, features a channel section 21, which forms an extension of the partial channel running in the base body 16 of the top frame 10. In this case, the channel 12 passed by the additive 9 consists of the partial channel of the base body 16 and the channel section 21 of the retaining section 20, whereas the channel outlet 17 is located in the area of the retaining section 20.

The invention is not limited to the illustrated and described embodiments. Variations within the framework of the claims, such as any combination of the described characteristics, even if they are illustrated and described in different parts of the description or the claims or in different embodiments.

The invention claimed is:

1. A spinning unit of an air jet spinning machine, comprising:

a spinning nozzle, the spinning nozzle further comprising
an inlet for a fiber composite;
an internal vortex chamber;
one or more air nozzles disposed to direct compressed air into the vortex chamber;
a yarn formation element protruding into the vortex chamber;
an outlet for a yarn produced in the vortex chamber;

an additive supply system that supplies an additive to the spinning nozzle, the additive supply system comprising
a top frame fixed on the spinning nozzle; and
an additive supply line in communication with a source of additive, the additive supply line connected to the top frame, wherein additive is delivered by the additive supply line to the top frame, and the top frame further comprising an internal channel that is separate from a compressed air supply to the air nozzles, wherein the additive flows through the internal channel to the inlet of the spinning nozzle and is separated from the compressed air flowing through the air nozzles.

2. The spinning unit as in claim 1, wherein the top frame is detachably fixed to the spinning nozzle with a clip.

3. The spinning unit as in claim 1, wherein the top frame is made at least partially of plastic.

4. The spinning unit as in claim 1, wherein the internal channel comprises a channel inlet that is communication with the additive supply line, and a channel outlet that is in communication with an inlet area of the spinning nozzle.

5. The spinning unit as in claim 4, further comprising a fiber guide element in the inlet area of the spinning nozzle, the channel outlet disposed in an area of the fiber guide element such that the additive flowing from the channel is brought into contact with the fiber composite in the fiber guide element.

6. The spinning unit as in claim 5, wherein the top frame comprises an end section that encloses the channel outlet, the end section fixed on the fiber guide element.

7. The spinning unit as in claim 6, wherein the end section is formed as a ring-shaped member and is fixed in a positive-locking manner to a ring-shaped retaining section at the fiber guide element.

8. The spinning unit as in claim 7, wherein the retaining section at least partially surrounds the fiber guide element.

9. The spinning unit as in claim 8, wherein the retaining section is detachably connected to a base body of the top frame and is formed of a different material from the base body.

10. The spinning unit as in claim 8, wherein the retaining section comprises a channel section in communication with the inlet to the spinning nozzle, the channel section oriented in a direction transverse to a transport direction of the fiber composite introduced through the fiber guide element into the spinning nozzle.

11. The spinning unit as in claim 1, wherein the top frame is fixed to a spinning air entry element of the spinning nozzle.

12. The spinning unit as in claim 1, wherein the internal channel comprises a channel inlet that is communication with the additive supply line, and a channel outlet that is in communication with an inlet area of the spinning nozzle, the internal channel comprising a curved or bent run portion.

* * * * *